United States Patent [19]

Inoue

[11] Patent Number: 5,064,393

[45] **Date of Patent: * Nov. 12, 1991**

[54] PROTECTOR FOR THE STARTING GRIP OF OUTBOARD MOTOR

[75] Inventor: Seiji Inoue, Shizuoka, Japan

[73] Assignee: Sanshin Kogyo Kabushiki Kaisha, Hamamatsu, Japan

[ * ] Notice: The portion of the term of this patent subsequent to Apr. 28, 2004 has been disclaimed.

[21] Appl. No.: 98,761

[22] Filed: Sep. 17, 1987

Related U.S. Application Data

[63] Continuation of Ser. No. 815,574, Jan. 2, 1986, abandoned.

[30] Foreign Application Priority Data

Jan. 11, 1985 [JP] Japan ..... 60-3687

[51] Int. Cl.[5] ..... B63H 21/36

[52] U.S. Cl. ..... 440/77; 440/88; 440/900

[58] Field of Search ..... 440/77, 85, 76, 88, 440/900; 123/179 SE, 185 A, 195 C, 195 P; 15/225

[56] References Cited

U.S. PATENT DOCUMENTS

| | | | |
|---|---|---|---|
| 236,414 | 1/1881 | Briggs | 16/225 |
| 2,547,128 | 4/1951 | Kiekhaefer | 440/76 |
| 2,676,559 | 4/1954 | Davies | 440/77 |
| 3,358,668 | 12/1967 | Post et al. | 440/77 |
| 3,696,593 | 10/1972 | Thorud et al. | 123/179 SE |
| 3,773,010 | 11/1973 | Elingsen | 440/77 |
| 3,885,547 | 5/1975 | Doepke et al. | 123/198 D |
| 4,348,194 | 9/1982 | Walsh | 440/77 |
| 4,493,661 | 1/1985 | Iwai | 440/77 |
| 4,661,076 | 4/1987 | Iwai | 440/77 |

*Primary Examiner*—Sherman Basinger
*Assistant Examiner*—Thomas J. Brahan
*Attorney, Agent, or Firm*—Ernest A. Beutler

[57] ABSTRACT

A number of embodiments of outboard motor constructions wherein an arrangement is provided for precluding inadvertent operation of the manual starting handle. In each embodiment, this is achieved by means of a safety member that precludes access to the starter handle. In some embodiments, this is achieved by means of a cover member which blends into the cowling and which protects the starter handle while in another embodiment, it is provided by a latch embodiment. In some embodiments, there is also a lubricant storage tank that has its fill cap accessible through the opening of the protective cover.

8 Claims, 6 Drawing Sheets

29
23
37
24
28
32
34
40
45
36
35
44
66
71
72
67
69
68
64
65
63
39
2
61
59
62
58
33
31
41
4
27
43
42
25
26
54
38
21
22

Fig-2
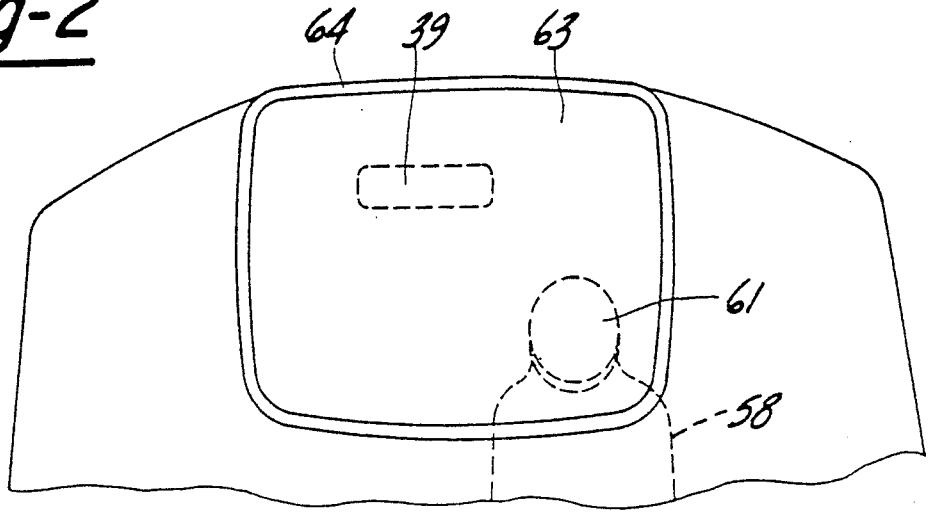
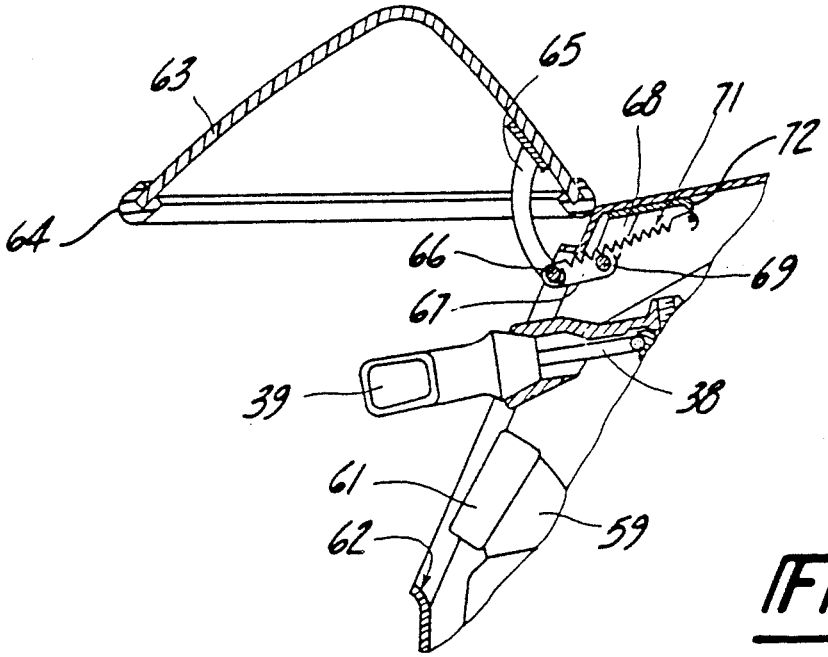
Fig-3

PROTECTOR FOR THE STARTING GRIP OF OUTBOARD MOTOR

This is a continuation of U.S. patent application Ser. No. 815,574, filed Jan. 2, 1986, now abandoned.

BACKGROUND OF THE INVENTION

This invention relates to a protector for the starting grip of an outboard motor and more particularly to a device that will prevent inadvertent manual operation of the manual starter of an outboard motor.

As is well known, many outboard motors employ a mechanism for manual starting. Such mechanisms may be employed either alone or as a backup to the electric starter of the outboard motor. If a manual starter of the recoil type is provided, it is the normal practice to provide a starter handle or grip at the end of the pull starting rope which the operator grasps and pulls to start the outboard motor. Normally at least the starter handle is exposed from externally of the protective cowling of the outboard motor so as to permit the manual starting. Although this type of device has general practicality, it does permit the handle to be exposed in such a manner that it may be inadvertently operated by the operator when the outboard motor is running. If manual operation of the pull starter is attempted when the motor is running, there may be damage to the starter mechanism or to the motor itself.

It is, therefore, a principal object of this invention to provide an improved device for insuring against inadvertent operation of the manual starter of an outboard motor.

It is a further objection of this invention to provide an improved arrangement for precluding manual starting of an outboard motor except when desired.

The exposed manual starter or starter handle of outboard motors tends to create an unsightly appearance or one which does not suggest a modern, streamline configuration.

It is, therefore, a further object of this invention to provide a protective cover for the pull handle of a manual starter for an outboard motor which blends into the remaining protective cowling to give a smooth and streamlined overall configuration.

Recently, it has been proposed to employ separate lubricating systems for even small manual started outboard motors. Such separate lubricating systems include an oil reservoir or oil storage tank that is positioned in proximity to the outboard motor and specifically to the engine of the outboard motor. Although such tanks may be contained or confined within the protective cowling, this does not lend itself to convenient replenishment of the oil within the tank when required.

It is, therefore, a still further object of this invention to provide an improved arrangement for facilitating filling of a lubricant storage tank that is contained within the protective cowling of the outboard motor and which will, nevertheless, prevent leakage of external liquids such as rain or the like to the interior of the protective cowling.

SUMMARY OF THE INVENTION

A first feature of this invention is adapted to be embodied in an outboard motor that is comprised of an internal combustion engine, a pull starter for the internal combustion engine that has a starter handle for manual operator starting and a protective cowling that surrounds the internal combustion engine and which leaves the starter handle exposed. In accordance with this feature of the invention, selectively releasable safety means are provided for precluding operation of the starter handle.

Another feature of this invention is adapted to be embodied in a protective cowling arrangement for an outboard motor that is comprised of an internal combustion engine and a lubricant storage tank supported in proximity to the engine and which has a filling opening. A protective cowling encircles the internal combustion engine and the lubricant storage tank and has an opening through which the filling opening of the lubricant tank extends. A closure member is affixed to the filling opening of the lubricant tank in proximity to and overlying the opening of the protective cowling. A cover is carried by the protective cowling and is selectively movable between an opened position that affords access to the filling opening and a closed position wherein the filling opening and removable closure are concealed.

BRIEF DESCRIPTION OF THE DRAWINGS

FIG. 2 is a front elevational view taken in the direction of the arrow 2 in FIG. 1.

FIG. 3 is a partial view, in part similar to FIG. 1, showing the starter handle and oil filling cover in its opened position.

DETAILED DESCRIPTION OF THE PREFERRED EMBODIMENTS

Figure 1:
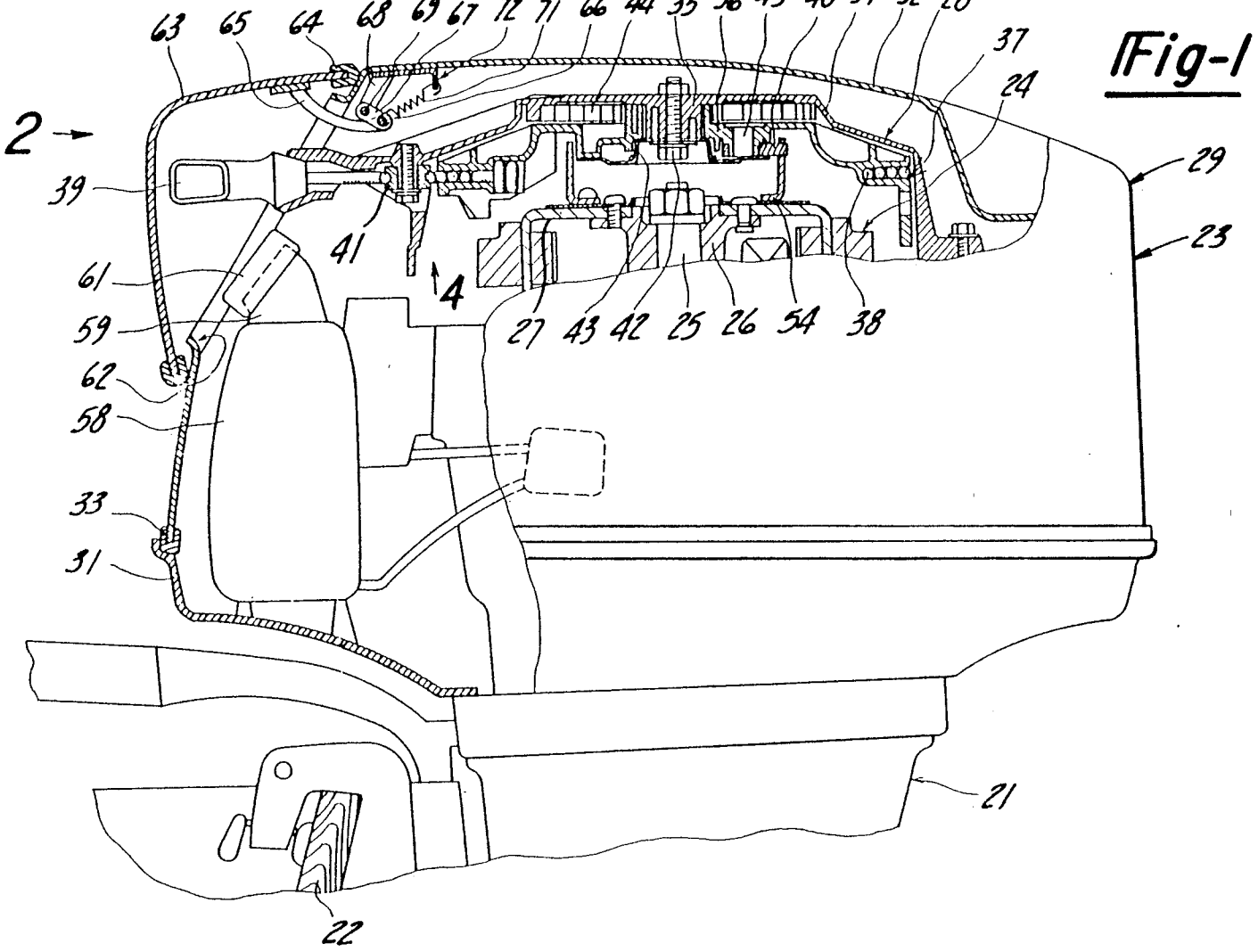
FIG. 1 is a partial side elevational view of an outboard motor constructed in accordance with a first embodiment of the invention, with a portion broken away.

Referring first to the embodiment of FIGS. 1 through 5, an outboard motor constructed in accordance with this embodiment is identified generally by the reference numeral 21. The motor 21 is adapted to be affixed to a transom 22 of an associated watercraft in a known manner. The motor 21 is comprised of a power head, indicated generally by the reference numeral 23, from which a drive shaft housing and lower unit depend. Inasmuch as the invention relates to the construction of the power head 23, the remainder of the outboard motor 21 has not been shown in any detail and will not be described.

The power head 23 is comprised of an internal combustion engine, which may be of any known type and for that reason has been illustrated only partially and is identified generally by the reference numeral 24. The engine 24 has an output shaft 25 that is journaled for rotation about a generally vertically extending axis and to which a hub portion 26 of a flywheel 27 is affixed in a known manner. The flywheel 27 may include a magneto generator assembly which may be of any known type and, for that reason, has not been illustrated in any detail. As has been noted, the construction of the engine 24 per se forms no part of the invention other than the construction of the manual pull type starter, indicated generally by the reference numeral 28, and its association with the engine 24 per se.

The engine 24 is surrounded by a protective cowling assembly, which is indicated generally by the reference numeral 29 and which comprises a lower tray 31 and a main cover 32 that is affixed to the tray 31 in a known manner. An elastomeric seal 33 encircles the lower periphery of the cover 32 and sealingly engages the tray 31 so as to provide a generally watertight enclosure for the engine 24.

The pull type starter 28 includes a supporting case 34 that is affixed to a non-rotating part of the engine 24 in generally overlying relationship to the output shaft 25 and flywheel 27. The case 34 has a hub portion 35 that journals a pulley 36 having a peripheral groove 37 into which a starter rope 38 is wound. One end of the starter rope 38 is affixed to the pulley 36 in a suitable manner while the other end is affixed to a starting handle 39. A pulley 41 or guide is carried by the starter case 34 and the starter rope passes across the pulley 41 adjacent the handle 39 so that the handle 39 may be pulled in a generally horizontal direction so as to rotate the starter pulley 36.

A bolt and nut assembly 42 is provided for securing a pulley supporting plate 43 to the underside of the starter case 34 so that the pulley 36 will be rotatably journaled but axially fixed relative to the starter case 34.

A torsional spring 44 is loaded between the starter case 34 and the pulley 36 and is wound up as the starter handle 39 is pulled outwardly so as to increase its tension. When the starter handle 39 is released, the spring 44 will rotate the pulley 36 in a reverse direction so as to rewind the starter rope 38 into the groove 37.

A pivot pin 45 is affixed to and depends from the lower side of the pulley 36. A starter pawl 46 is journaled upon the pivot pin 45 and has a pair of cam surfaces 47 and 48 that are adapted to cooperate with a cam member 49 that has a frictional engagement with an outer surface 51 of the plate 43. The cam member 49 is provided with a pair of lugs 52 and 53 that are adapted to cooperate with the pawl cam surfaces 47 and 48 in a manner to be described.

A starter ring 54 is affixed to the upper side of the flywheel 27 for simultaneous rotation with it and the engine output shaft 25. The starter ring 54 has a pair of diametrically spaced openings 55 that are sized to receive an end of the starter pawl 46, in a manner to be described.

Figure 4:
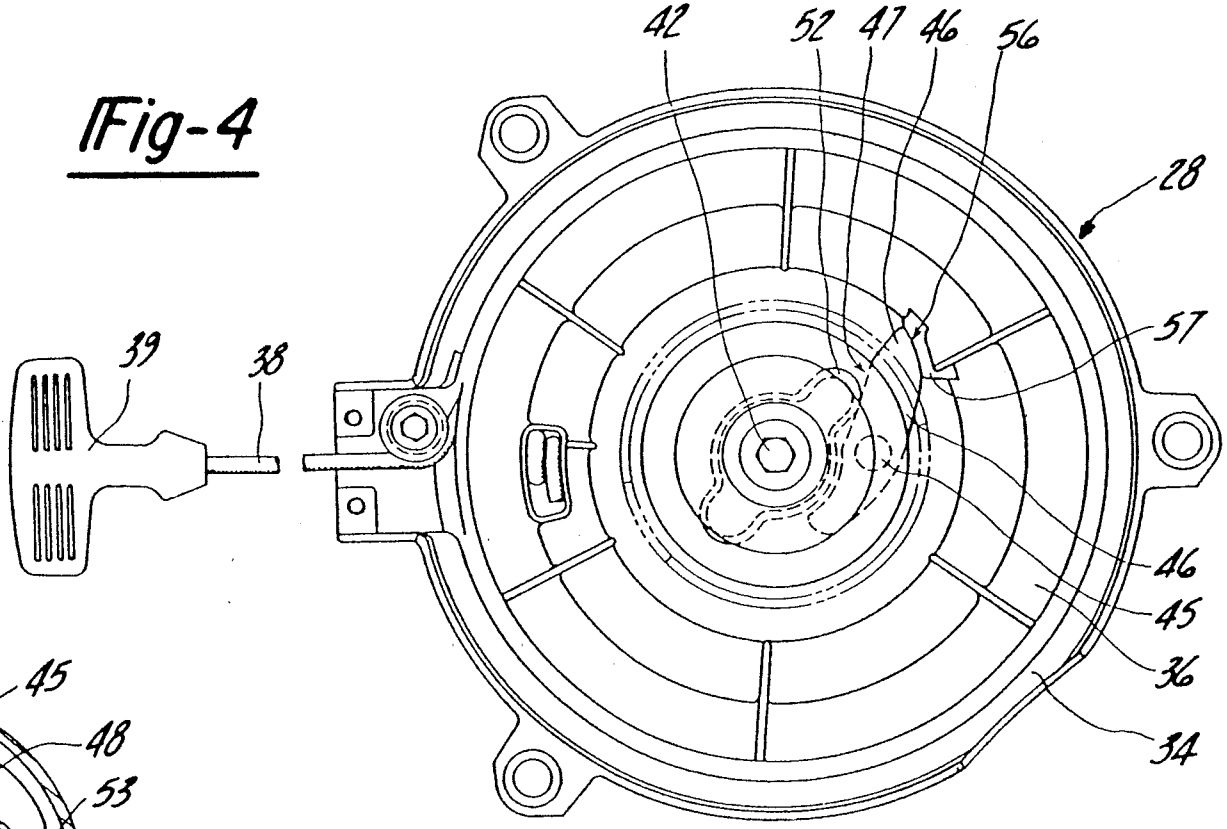
FIG. 4 is a view looking generally in the direction of the arrow 4 in FIG. 1 showing the starter mechanism.
Figure 5:
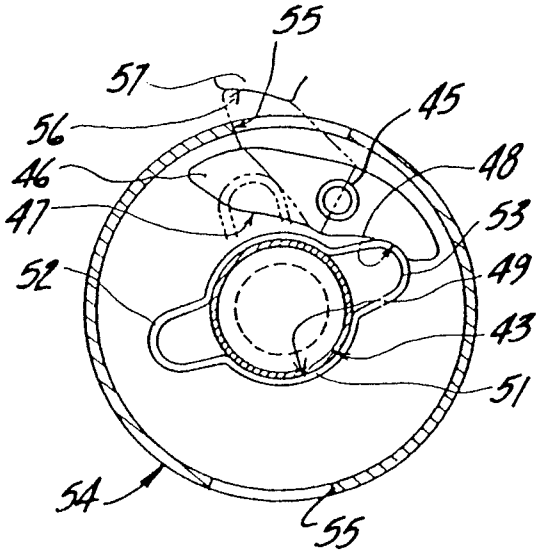
FIG. 5 is a view, in part similar to FIG. 4, showing the operation of the starter mechanism.

When the starter handle 39 is grasped and the starter rope 38 is pulled outwardly, the starter pulley 36 will rotate in a counterclockwise direction as shown in FIGS. 4 and 5. This rotation will continue and eventually one of the lugs 52 or 53 will contact the pawl cam surface 47 and cause it to pivot outwardly in a clockwise direction about the pivot pin 45. When the pawl 46 becomes aligned with one of the openings 55, the force will urge the pawl outwardly into the opening 55 wherein its outer cam surface 56 will engage a stop member 57 carried by the pulley 36 so as to limit the pivotal movement of the pawl 46. The minute the pawl 46 enters into the opening 55, the forward portion of the cam surface 47 will engage the edge of the starter ring which defines the opening 55 and the starter ring will also be rotated in a counterclockwise direction so as to exert a rotary force on the engine output shaft 25 so as to pull start the engine.

When the engine has been started, the starter ring 54 will overrun the pulley 36 and engage the back side of the pawl 46 so as to pivot it back toward a released position. At the same time, the rewinding of the pulley 36 by the spring 44 will cause the pawl 46 to be rotated so that its cam surface 48 engages the other lug 52 or 53 so as to further pivot it back to the retracted position.

The engine 24 is provided with a separate lubricating system that includes a lubricant supply tank 58 that is supported within the protective cowling 29 in proximity to the front of the engine. The lubricant supply tank 58 has a filler neck 59 to which is affixed a closure cap 61. Removal of the closure cap 61 will permit an operator to refill the lubricant in the tank 58 as desired.

The conventional protective cowling 29 and specifically the cover member 32 is formed with an opening 62 through which the starter handle 39 projects and which is in proximity to the filler neck 59 and filler cap 61 so as to permit replenishment of the oil and access to the starting handle 39.

As has been noted, the exposure of the starting handle 39 places it in a position wherein the starter handle 39 may be inadvertently pulled when the engine 24 is running. In addition, the opening 62 can permit foreign material to enter into the interior of the protective cowling 29 and also provides a less than desirable appearance.

To avoid the aforenoted objections, the protective cowling 29 is provided with a separate closure member or cover 63 that is adapted to close the opening 62 and contain the starter handle 39 so that it cannot be inadvertently pulled when the engine is running. The cover member 63 is provided with a peripheral gasket 64 that is adapted to engage and seal the area of the protective cowling cover member 32 surrounding the opening 62.

The cover member 63 is supported for movement between a closed and an opened position by means including a supporting bracket 65 that is affixed at one end to the interior of the cover 63. The other end of the bracket 65 is connected by means of a pivot pin 66 to a link 67 that is pivotally supported on the protective cowling 29 and specifically upon a bracket 68 that is affixed to the interior of the cover member 63 adajacent the upper edge of the opening 62. The link 67 is pivotally connected on the bracket 68 by means of a pivot pin 69. A tension spring 71 is interposed between a tab 72 and the pivot pin 66 for urging the cover member 63 to both its closed and its opened positions.

In the closed position of the cover member 63 as seen in FIG. 1, the tension spring 71 acts to urge the bracket 65 in such a direction that the peripheral seal 64 is held in tight engagement with the main cowling cover member 29 around the opening 62. However, if an operator desires to either pull start the engine or to add oil to the lubricant supply tank 58, he merely grasps the cover member 63 and urges it upwardly. The pivot pin 66 will pass in over-center relationship to the pivot pin 69 and the spring 71 will then urge the cover member 63 to its fully opened position as shown in FIG. 3. Hence, because of this over-center relationship, the spring 71 acts to hold the cover member in either of its opened or closed positions.

It should be noted from FIGS. 1 through 3 that the cover member 63 is configured so as to blend smoothly into the configuration of the cover member 29 of the outer cowling so as to provide a smooth and steamlined and pleasant appearance. Thus, the cover member provides not only security for accidental starting, insures against water leakage but it also improves the overall appearance of the outboard motor.

Figure 6:
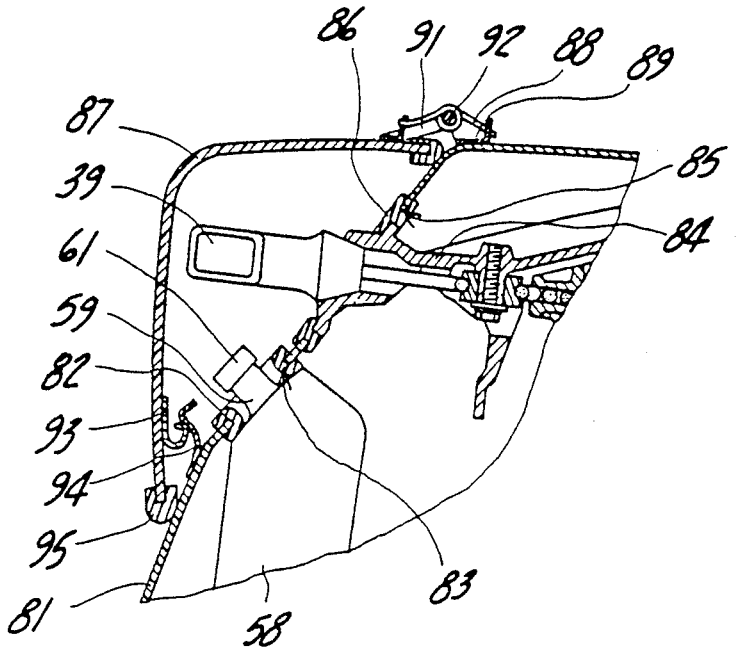
FIG. 6 is a partial side elevational view, similar to FIG. 1, and shows a second embodiment of the invention.

FIG. 6 illustrates another embodiment of the invention that is generally similar to the embodiment of FIGS. 1 through 5. For that reason, those components which are the same as the previously described embodiment have been identified by the same reference numerals. In addition, portions of this embodiment which do not differ from the previously described embodiment have not been illustrated.

In this embodiment, a main cowl member 81 of the protective cowling is not formed with a relatively large opening through which the starter handle 39 and filler neck 59 extend. Rather, the cowling member 81 is formed with a first opening 82 through which the filler neck 59 extends and which carries an elastomeric seal 83 that engages the portion of the tank 58 around the filler neck 59 so as to provide against water leakage. In a similar manner, a guide member 84 of the starter cover plate 34 passes through an opening 85 formed in the cowling member 81. An elastic seal 86 is interposed between the cover member opening 85 and the guide member 84 so as to insure against leakage.

In this embodiment, the starter handle 39 and filler neck 59 and closure cap 61 are covered by a protective cover 87 that is hinged to the main cowling member 81 by means of a torsional hinge assembly comprised of torsional springs 88 that are fixed at one end to brackets 89 that are carried by the outer cowling 81. The opposite end of the torsional springs are connected to the cover member 87 by means of hinge plates 91 and hinge pins 92. The torsional springs 88 exert a force on the cover 87 that tends to pivot it to an opened direction.

The cover 87 is retained in its closed position by means of a pair of spring clips 93 that are carried by the cover 87 and which engage spring brackets 94 carried by the cowling 81 so as to retain the cover 87 in its closed position against the action of the torsional spring 88. As in the previously described embodiment, a seal 95 is carried by the periphery of the cover 87 and sealingly engages the outer cowling member 81 so as to prevent leakage when the cover is closed. It is believed that the operation of this embodiment is clear from the foregoing description. That is, an operator may open the cover 87 to access the filler neck 59 and cap 61 or starter handle 39 by grasping the cover 87 and urging it upwardly so as to release the spring clips 93 and 94 and permit the torsional spring 88 to pivot the cover to its opened position. Closure is achieved by forcing the cover 87 downwardly against the action of the torsional springs 88 to re-engage the spring clips 93 and 94.

Figure 8:
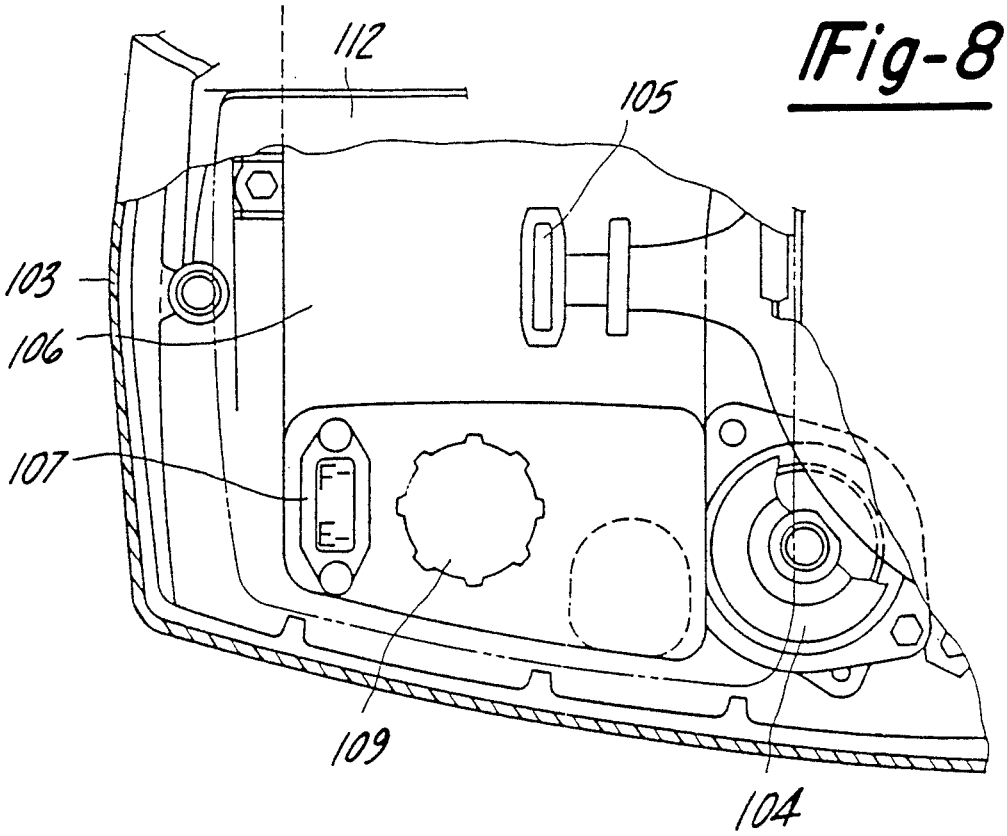
FIG. 8 is partial top plan view, with portions broken away, of the embodiment of FIG. 7.
Figure 7:
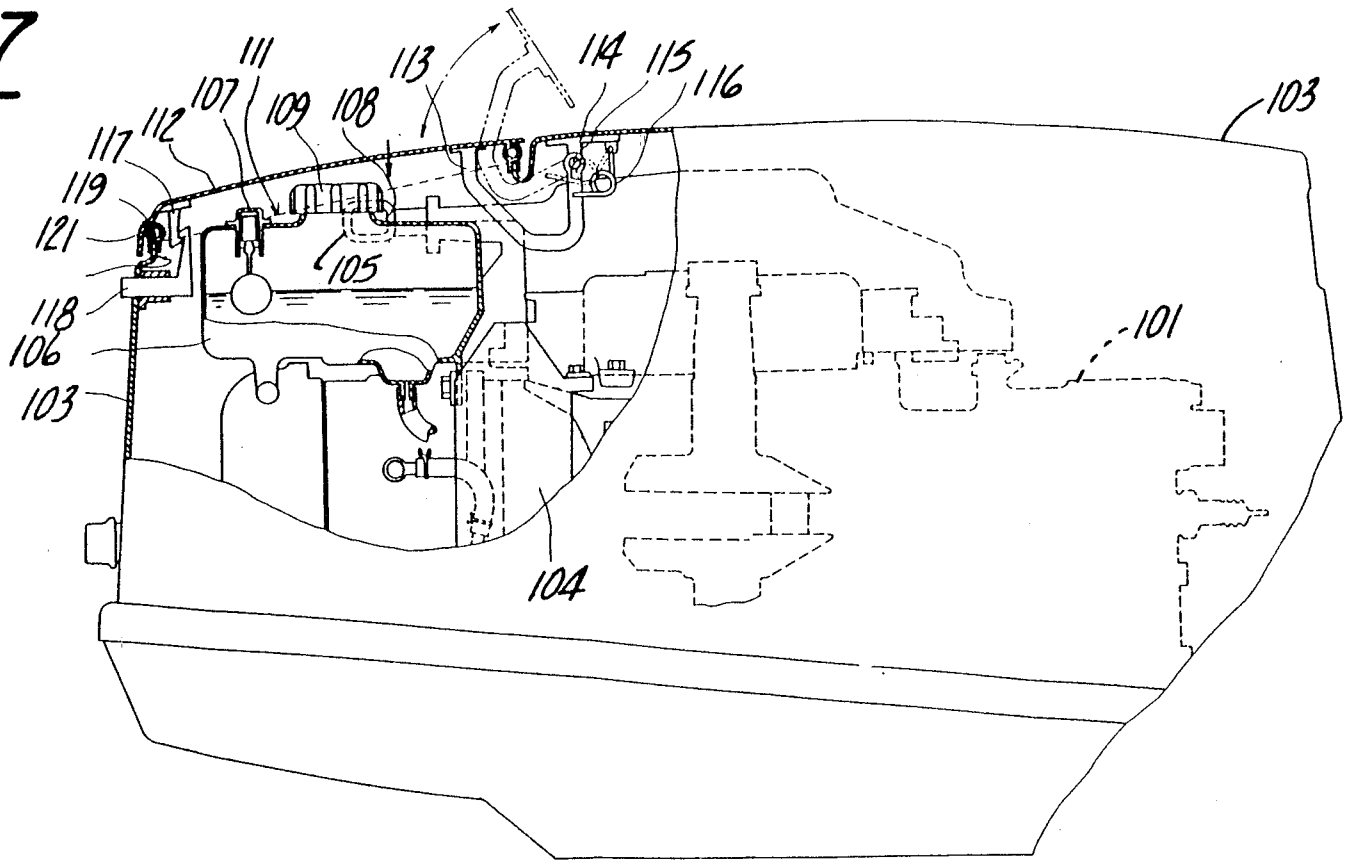
FIG. 7 is a partial side elevational view, with a portion broken away, in part similar to FIGS. 1 and 6, showing a third embodiment of the invention.

FIGS. 7 and 8 show a further embodiment of the invention, which is generally similar to the preceding embodiment and, for that reason, only those components which differ from those of the preceding embodiment will be described and discussed in detail.

In connection with this embodiment, an internal combustion engine, indicated generally by the reference numeral 101, is covered by a protective cowling consisting of a lower tray 102 and a main cover portion 103. In this embodiment, the engine 101 is provided with an electric starter 104. However, there is also provided a manual pull starter for emergency starting which includes a starter handle 105 and which starter has the construction as of the type described in conjunction with the embodiment of FIGS. 1 through 5.

A separate lubricating system is also provided for the engine 101 and this includes a lubricant storage tank 106 that is disposed adjacent to the forward upper portion of the engine and which carries a liquid level gauge 107 and a filler neck 108 that is closed by a closure cap 109. The fill gauge 107 and fill cap 109 are provided on the upper surface and are disposed in proximity to an opening, indicated generally by the reference numeral 111, of the top cowling portion 103.

The opening 111 is normally closed by means of a closure or cover plate 112 which conceals both the liquid level gauge 107, fill cap 109 and starter handle 105. The cover plate 112 is pivotally supported by means of a bracket 113 that is carried by the main cowling member 103 by means including a bracket 114 and pivot pin 115. A torsional spring 116 is provided for normally urging the cover plate 112 to its opened position.

A latch mechanism comprised of a latching member 117 and a releasable lock 118 are carried by the cover member 112 and cowling member 103, respectively, for holding the cover 112 in its closed position.

A sealing gasket 119 is carried by a peripheral flange 121 surrounding the opening 111 so as to provide a liquid tight seal when the cover 112 is in its closed position. The operation of this embodiment is believed to be clear from the previous description of the other generally similar embodiments.

Figure 9:
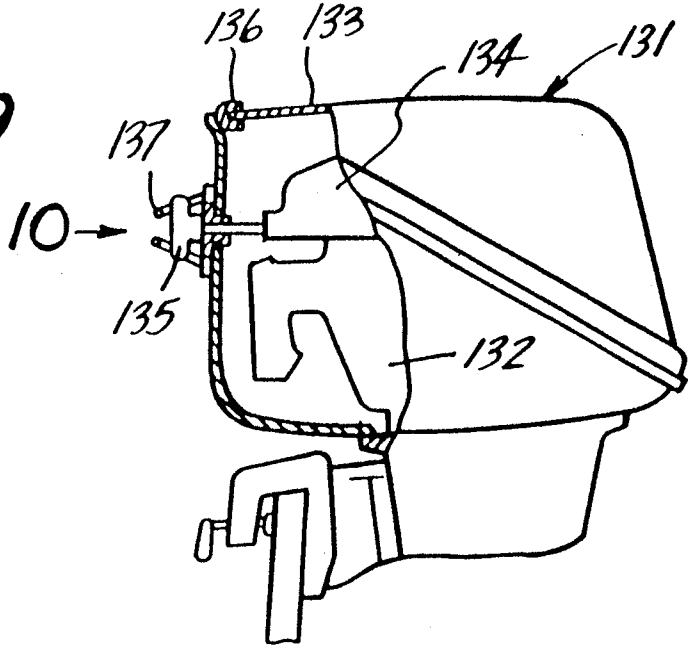
FIG. 9 is a side elevational view, with portions broken away, of a still further embodiment of the invention.
Figure 10:
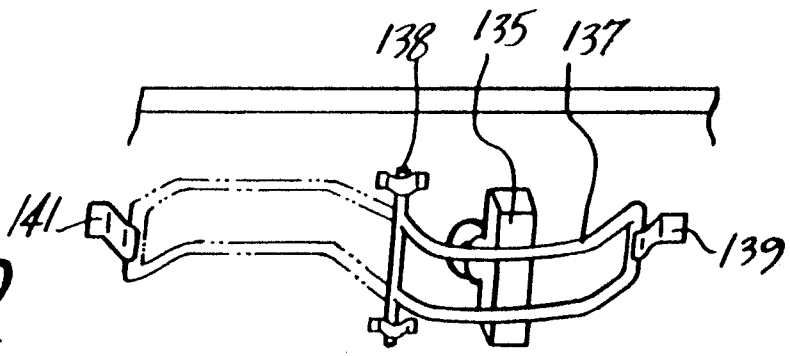
FIG. 10 is a perspective view on an enlarged scale showing the details of the embodiment of FIG. 9.

In each embodiment of the invention as thus far disclosed, inadvertent operation of the pull starter has been provided by concealing the starter handle within a protective cover. FIGS. 9 and 10 illustrate a still further embodiment of the invention wherein a simpler arrangement is provided for precluding inadvertent starting. In this embodiment, an outboard motor is identified generally by the reference numeral 131 and includes an engine 132 that is surrounded by a protective cowling 133 and which has a pull starter mechanism 134 that is operated by means of a starter handle 135. In this embodiment, the starter handle 135 is freely accessible through an opening in the front half of the outer cowling 133. The outer cowling 133, by the way, is made of up two parts that are sealingly connected together by means of a seal 136.

In order to prevent inadvertent operation of the pull starter handle 135, there is provided a latch mechanism, indicated generally by the reference numeral 137. The latch mechanism 137 is selectively releasable and is comprised of a formed wire member that is pivotally supported on the outer cowling 133 by means of a pivot pin 138. A pair of spring latches 139 and 141 are provided, respectively, for locking the latch 137 in either the safety or operating positions, respectively.

FIG. 9 and the solid line view of FIG. 10 show the safety position wherein the latch 137 is retained over the starter handle 135 by the spring clup 139. If the operator desires to permit manual starting, the latch 137 is released and may be held in its released position by engagement with the spring latch 141 and the starter handle 135 may be pulled for pull starting. Once the engine is started, the latch 137 should be returned from its inoperative or released position to its engaged position to prevent inadvertent operation once the engine 132 is running.

Figure 11:
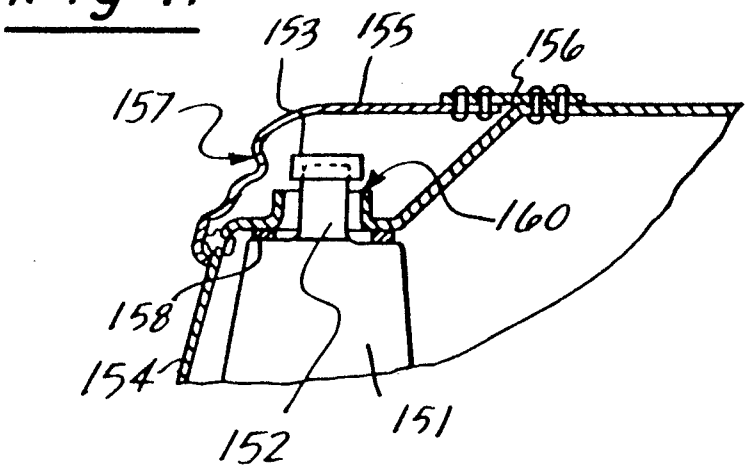
FIG. 11 is a partial side elevational view, with parts shown in cross-section, in part similar to FIGS. 1, 6, 7 and 9, showing a still further embodiment of the invention.

FIG. 11 illustrates a still further embodiment of this invention. In this embodiment, all that is illustrated is the cooperation of the cover with a lubricant storage tank, indicated generally by the reference numeral 151, and which has a filler neck 152 to which a filler cap 153 is detachably removed.

The engine has an outer cowling comprised of an upper cowling member 154 that has an upstanding opening defined by a neck 155 that surrounds the filler neck 152. The neck 160 is approximately the same size or smaller than the cap 153 so that the cap 153 will cooperate to prevent leakage into the filler neck. The cover member 155 is provided which is hinged to the main cowling member 154 by means of a flexible strap hinge 156. The cover member 155 is formed with an integral handle portion 157 so as to facilitate its operation.

An elastomeric seal 158 surrounds the protective cowling 154 and engages the upper surface of the lubricant storage tank 151 around its fill neck 152 to prevent leakage into the interior of the protective cowling.

Although the starter handle is not shown in FIG. 11, it is to be understood that if one is employed, it also can be protected by the cover 155.

It should be readily apparent from the foregoing description that the number of embodiments of the invention have been illustrated and described, each of which precludes inadvertent operation of the starter handle when the engine of the outboard motor is running. In addition, this same cover member in some embodiments operates to protect and give access to the filling of the lubricant storage tank contained within the protective cowling.

Although a number of embodiments of the invention have been illustrated and described, it is to be understood that still other changes and modifications may be made without departing from the spirit and scope of the invention, as defined by the appended claims.

I claim:

1. In an outboard motor comprised of an internal combustion engine, a protective cowling surrounding said engine, a pull starter for said internal combustion engine contained within said protective cowling, a rope affixed at one end to said pull starter for operating said pull starter, said rope extending through an opening in said protective cowling and having a starting handle affixed to the other end of said rope for manual operated starting, said protective cowling leaving said starter handle exposed for operation without removing said protective cowling and while said protective cowling contains said engine and a cover movably supported by said protective cowling between a closed position wherein said starting handle is concealed, for precluding operation of said starting handle and an opened position wherein said starting handle is accessible for starting said engine.

2. In an outboard motor as set forth in claim 1 wherein the cover is biased to a closed position.

3. In an outboard motor as set forth in claim 2 wherein the cover is biased by an over-center spring so it will be biased to both the opened the closed positions.

4. In an outboard motor as set forth in claim 3 wherein the cover is biased to a closed position.

5. In an outboard motor as set forth in claim 4 further including releasable latching means for holding the cover in its closed position.

6. In an outboard motor as set forth in claim 1 further including a lubricant storage tank contained within the protective cowling and having a fill cap covered by the cover when the cover is in its closed position.

7. In an outboard motor as set forth in claim 6 wherein the starter handle and fill cap each extend through respective openings formed in the protective cowling.

8. In an outboard motor as set forth in claim 7 wherein the cover member is carried by the protective cowling by means of a flexible strap.

* * * * *